US007234404B2

(12) United States Patent
Tissier

(10) Patent No.: US 7,234,404 B2
(45) Date of Patent: Jun. 26, 2007

(54) WATER CRAFT WITH A SAIL

(76) Inventor: Francois Tissier, 37, Rue de Montvinard, Nouaille Maupertuis (FR) 86340

( * ) Notice: Subject to any disclaimer, the term of this patent is extended or adjusted under 35 U.S.C. 154(b) by 46 days.

(21) Appl. No.: 10/556,054

(22) PCT Filed: May 14, 2004

(86) PCT No.: PCT/FR2004/001200

§ 371 (c)(1),
(2), (4) Date: Nov. 8, 2005

(87) PCT Pub. No.: WO2004/101354

PCT Pub. Date: Nov. 25, 2004

(65) Prior Publication Data

US 2007/0056494 A1 Mar. 15, 2007

(30) Foreign Application Priority Data

May 14, 2003 (FR) ..... 03 05804

(51) Int. Cl.
*B63B 35/00* (2006.01)

(52) U.S. Cl. ..... 114/39.26

(58) Field of Classification Search ..... 114/39.26
See application file for complete search history.

(56) References Cited

U.S. PATENT DOCUMENTS

| | | | | |
|---|---|---|---|---|
| 3,232,264 A | | 2/1966 | O'Hagan | |
| 4,401,047 A | * | 8/1983 | Auras | 114/39.25 |
| 4,543,898 A | | 10/1985 | Castilla | |
| 4,852,507 A | * | 8/1989 | Ryon et al. | 114/39.26 |
| 4,930,433 A | * | 6/1990 | Tirez | 114/39.26 |
| 5,904,111 A | | 5/1999 | Frigard | |
| 6,386,130 B1 | | 5/2002 | Kuehne | |

FOREIGN PATENT DOCUMENTS

| | | |
|---|---|---|
| CH | 673 444 | 3/1990 |
| EP | 0 273 021 | 6/1988 |
| FR | 2 756 807 | 6/1998 |
| IT | 1 169 603 | 6/1987 |

* cited by examiner

*Primary Examiner*—Jesús D. Sotelo
(74) *Attorney, Agent, or Firm*—Young & Thompson

(57) ABSTRACT

A catamaran-type water craft includes a frame (1) which is fixed on two bodies forming floats (2) and a sail (5) for wind-driven displacement when the floats are on a stretch of water, characterized in that the water craft includes a central piloting station (6–8) whereby the pilot sits on a seat (7) of the piloting station, is provided with a handlebar which is located within arm's reach and which is used to control the orientation of steering rudders respectively provided at the rear thereof with two floats (2), in addition to a tappet for adjusting the useful length of a control element for the orientation of the sail in relation to the frame, passing via a return pulley which is advantageously provided at the end of a swinging boom fixed to the rear of the water craft beyond the floats.

15 Claims, 4 Drawing Sheets

WATER CRAFT WITH A SAIL

The present invention is aimed at designing and producing a nautical craft with a sail that offers possibilities of use and conditions of safety, comfort and pleasure that cannot be obtained with present-day craft. It is more particularly aimed at such craft for coastal pleasure sailing.

The practice of sailing on traditional sailing boats requires a good technique and a good physical condition on the part of the sailors. On a sailboard, steering the craft in a given course requires one to move with agility on the board, while at the same time controlling the position and orientation of the sail using a kind of spar that is commonly known as a wishbone. The user has therefore to have a very good sense of balance.

With a more traditional boat comprising one or more hulls and a non-inclinable mast, the impact of the distribution of weight as a function of the position occupied by the sailor or sailors in the fore and aft direction (in the longitudinal direction of the craft) is not so great, but the impact of the lateral movements is still just as essential. It is by using such movements to counter listing due to the action of the wind on the fabric of the sail that the helmsman controlling the tiller and the mainsail, and any crew that might be present (whose task is to take care of the jib when there is one) avoid capsizing.

Conversely, motorboats do not require comparable sporting qualities and can be used comfortably by a sailor remaining seated in a cockpit, without having to move for safety reasons. By contrast, the presence of an engine does of course lead to unpleasantness for the user, and has numerous disadvantages for the environment in terms in particular of atmospheric pollution and noise nuisance.

Finally, nautical craft have the advantage over other sports and/or leisure vehicles that they enjoy a great deal of freedom over wide areas where the wind can be used to provide the motive power. Mention may be made here, for example, of the land yacht or sandsailer that is steered from a seating position in a cockpit where all the controls are centralized, but is designed to run on land, particularly on beaches.

In order to meet the requirements that are being demonstrated at present and particularly insistently in the area of nautical pursuits, the present invention proposes a craft with two longitudinal hulls forming parallel floats, which are connected by a chassis supporting a central cockpit comprising a sail that is efficient in using the wind as a source of power, advantageously alone in order to move the craft along when said hulls are on an expanse of water, characterized in that a helmsman sitting on a seat in said cockpit has, within reach, a handlebar via which he controls the orientation of rudder blades provided at the rear of each of the two hulls, respectively, and a cleat for adjusting the useful length of a sheet for controlling the orientation of the sail with respect to said chassis.

As a preference, this sheet passes over a return pulley provided at the end of a boom fixed as a jib boom at the rear of the craft beyond said floats. According to some preferred embodiments of the craft according to the invention, the sheet, which is guided in sliding by such a return pulley, there meets a clew point of the sail which is fixed at the end of a spar keeping the sail taut from a mast mounted on said chassis and about which said spar is mounted such that it can rotate.

As an alternative, the invention is expressed, in some particularly advantageous embodiments, in the fact that the craft is controlled entirely from a central cockpit situated between the two hulls where the user sits on a seat at manual controls which determine, on the one hand, variations in orientation, with respect to the longitudinal axis of the craft, of rudder blades with which each of the hulls is respectively equipped and which, on the other hand, allow the sail to be hauled aft to a greater or lesser extent by altering its orientation with respect to said longitudinal axis.

As a preference, the user can also act by shifting his weight on said seat.

The invention is also manifested in secondary characteristics aimed more specifically either at controlling the rudder blades or at controlling the sail or at controlling both in combination. Thus, in particular, the craft according to the invention advantageously comprises means for defining paths imposed on the sheet means that transmit the control of the sail from the cockpit and/or on cables for transmitting the controls of rudder blades from the same cockpit, which run along fixed elements of the chassis between return pulleys mounted on these fixed elements.

The orientation of the sail is altered by adjusting the length of the sheet. The sheet is made of flexible rope, as is customary. It is attached at an end known as the fixed end to a clew point of the sail which is held by a spar some distance from the mast supporting a vertical edge of the sail and standing up from a fixed mast foot lying on the longitudinal axis of the craft. At an opposite end, known as the free end, it is fixed at will, by hand, to a securing cleat available to a user sitting in the cockpit in the same position in which he has access to a control for controlling the rudder blades.

By distinction with what would be an actual steering wheel analogous to that of a land motor car, it is advantageous, according to the invention, to form the steering controls (which determine the orientation of the rudder blades) in the form of a handlebar mounted to pivot at the end of a fixed handlebar stem in the cockpit, which handlebar the sailor user can in particular grasp via two symmetric handles so as to make it not turn with the supporting handlebar stem at the end of which it is mounted but make it tilt in a plane transverse to this axis. However, it will be noted here that the two types of movement, one of rotation and the other of tilting, could also be envisaged in combination, but that this leads to slightly more complicated manufacturing conditions that it would generally be preferable to avoid.

The arrangement involving a handlebar defined here is not a restriction on the embodiments of application of the invention. Nonetheless, it does have the advantage of being an easy and convenient way of producing the steering controls of the craft by action on the rudder blades via cables or other lines attached to such a tilting handlebar. An advantageous couple is ensured in particular when provision is made for the opposite end of such cables to the end fixed directly to a local pivot control rod specific to each rudder blade to be attached to an end of the handlebar distant from its point of mounting in the handlebar stem that constitutes the support shaft, and therefore in particular at one or other of two lateral handles of this handlebar. Stated differently, a handlebar control arrangement such as this makes it possible to increase the control travel of the rudder blades.

As a preference, two such cables are provided arranged symmetrically from each of the respective handles of the handlebar to each of the respective two ends of a movement coordinating linkage connecting two bars each converting a pulling control on a cable caused by pressure on the handle to which it is attached into a pivoting movement of the corresponding rudder blade about the spindle via which it is mounted to rotate on the corresponding hull. According to variant embodiments of the invention, it is possible to ensure that the paths imposed on the cables cross and thus each pass from one side of the axis of symmetry of the craft to the other or for these paths not to cross. However, one of the benefits of steering controls formed in the way explained here in the case of a handlebar is that there is no need to organize, for the cables, a guide path that entails the two of them crossing in order to allow the user seated in the cockpit to instinctively find the same manual control movements as if he were operating a bicycle handlebar, the same also as those used on a conventional sailing boat tiller. Indeed, all that is required is for the handlebar to rotate in a plane such that when the user translationally pushes on the handlebar handle held in his left hand (therefore pulling the other end of the handlebar with his left hand), he causes a change in heading to the right, and vice versa.

According to other advantageous features of the invention, the central cockpit, as it will in particular be positioned along the axis of the craft, in a space left free above the waterline between the two hulls of a craft of the catamaran type, comprises a user seat produced in such a way that the user can shift forward and backward. While at the same time having free access, without leaving his seat, to the controls arranged in front of him, namely, in particular, a handlebar for controlling two rudder blades mounted respectively at the rear of two hulls that cause the craft to float, and a cleat for securing the free end of a sheet for pulling on the sail, the user can thus move in the longitudinal direction, allowing him to influence the position of the center of gravity of the craft. In this respect, a particularly comfortable seat may consist of a canvass stretched in the manner of a hammock between two cross members of the chassis connecting the two hulls. In preferred embodiments of the invention, the seat may be designed in such a way that the user can also shift his weight in the transverse direction, from one side of the axis of symmetry of the craft to the other, rather than just in the longitudinal direction.

According to yet another feature of the invention, the hulls or floats are each advantageously in the shape of a planing hull in cross section. This, for an increased speed capability, contributes to ensuring a practically listless sailing or, in any event, sailing without the risk of capsizing even though the user sailing the craft may refuse to lean to counter the list.

In terms of the sail, it may be especially desirable, according to another feature of the invention, to guide the sheet that allows pulling on the sail over the end of a boom fixed as a jib boom at the rear of the cockpit and extending rearward beyond the floats. This arrangement can advantageously be combined with the arrangements which advantageously consist in giving the sail a curved shape at its lower edge so as to leave the space occupied by the helmsman sitting on his seat free in case the sail should swing abruptly from one side to the other, from port to starboard or vice versa, because what is lost in terms of height of sail fabric is then gained in terms of length. Furthermore and for the same reason, the tack of the sheet on the jib boom is advantageously offset heightwise relative to the position it would have had if it had been situated at hull level.

Particularly when the sail has a cut-out at its lower edge, as has just been explained, it is advantageous to provide a spar tensioning the sail in the longitudinal direction and which is in the shape of a bow, like the wishbone of a sailboard, leaving the sail free to fill under the action of the wind better than would be the case with a spar that held the sail along its entire length. Furthermore, this spar preferably runs in a more or less horizontal direction from a rotary point of connection to the mast holding the front edge of the sail along its entire height and which is situated at a height above the floats and the cockpit, like the rear end of the jib boom.

A sail tack jib boom protruding beyond the rear of the hulls as has just been specified generally has the advantage of making the invention easier to implement in craft capable of a planing effect over the water. This is because this arrangement advantageously combines with the hulls being produced in the form of short floats which are therefore easily able to operate as planing floats, this being in conjunction with their cross section. It also advantageously combines with an optimum choice of sail area, the sail then being increased in the length direction. In addition, since the sail is preferably sized with a curvature to leave space for the user's head when tacking or jibing, offsetting the jib boom heightwise combined with a lengthwise offset makes it possible to have a spar and therefore a sail which are long enough to recuperate in terms of length the loss of sail area in terms of width while at the same time avoiding having to increase the length of the floats of the craft.

According to some preferred embodiments of the invention, the control handlebar as mentioned hereinabove is pivot-mounted at the end of a handlebar stem which is fixed to a front cross member of the chassis and is angled toward the cockpit in the longitudinal plane of the craft, running vertically with respect to the waterline defined by the hulls, assumed to be horizontal, and the sheet can be secured as required in a cleat placed within reach of the helmsman seated in the cockpit, and advantageously fixed to this handlebar stem, facing the helmsman. The cleat is advantageously, and this is conventional in itself, a jamming cleat which jams the sheet between two toothed rollers.

Amongst the characteristics of the invention which relate more to the sail itself, emphasis must be placed on the one which consists in giving the lower edge of the sail a curved shape with a concave region facing downward so as to clear a space corresponding to the height of a helmsman sitting in the cockpit at head level. Through this measure, the movements of the sail from one side of the craft to the other, according to the heading being followed and the direction of the wind, do not impede the helmsman.

It is also advantageous to configure the sail, in terms of the ratio between its length at rest along the longitudinal axis of the craft (which will be relatively long) and its height along the mast (which will be relatively short), in such a way that the center of thrust of the wind is fairly low down on the waterline, in conjunction also with the overall width of the craft (its two catamaran hulls inclusive) and with the position of the mast foot along the longitudinal axis, so as to limit the possibilities of the craft listing enough to prevent any risk of capsizing even if the craft is placed in the hands of a complete novice.

According to some of the preferred embodiments of the invention, the mast is fixed to a chassis formed between two float-forming hulls similar to those of a catamaran with a possibility of pivoting about a more or less vertical axis, and is held in a more or less vertical position by shrouds, preferably at least three of these, advantageously consisting of rigid rods fixed obliquely to the chassis. According to yet another characteristic of the invention, these rods are fixed to a ring in which the mast can turn, and the ring is preferably positioned below the center of thrust of the wind. Furthermore, a mast foot produced with the possibility of inclining the mast when it is not being held in place by such shrouds makes the sail easier to fit prior to sailing.

The invention will now be described more fully in the context of some preferred characteristics and of their advantages, with reference to FIGS. 1 to 5 in which.

Figure 2:
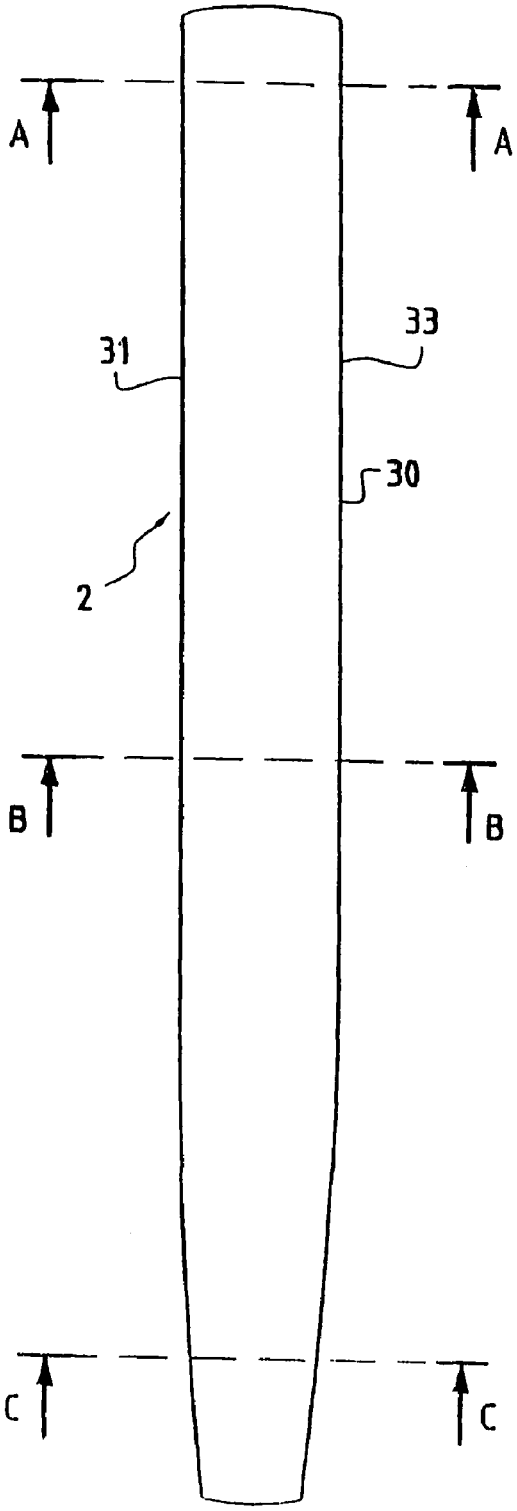
FIG. 2 illustrates a view from above of one of the floats.
Figure 3A:
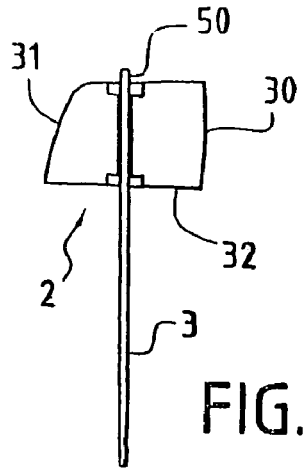
Figure 3B:
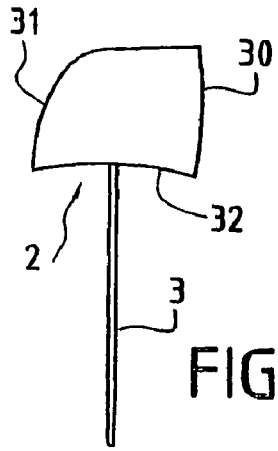
Figure 3C:
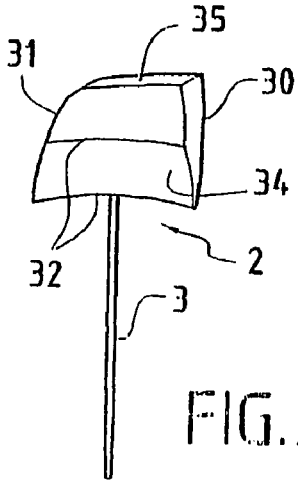
Figure 4:
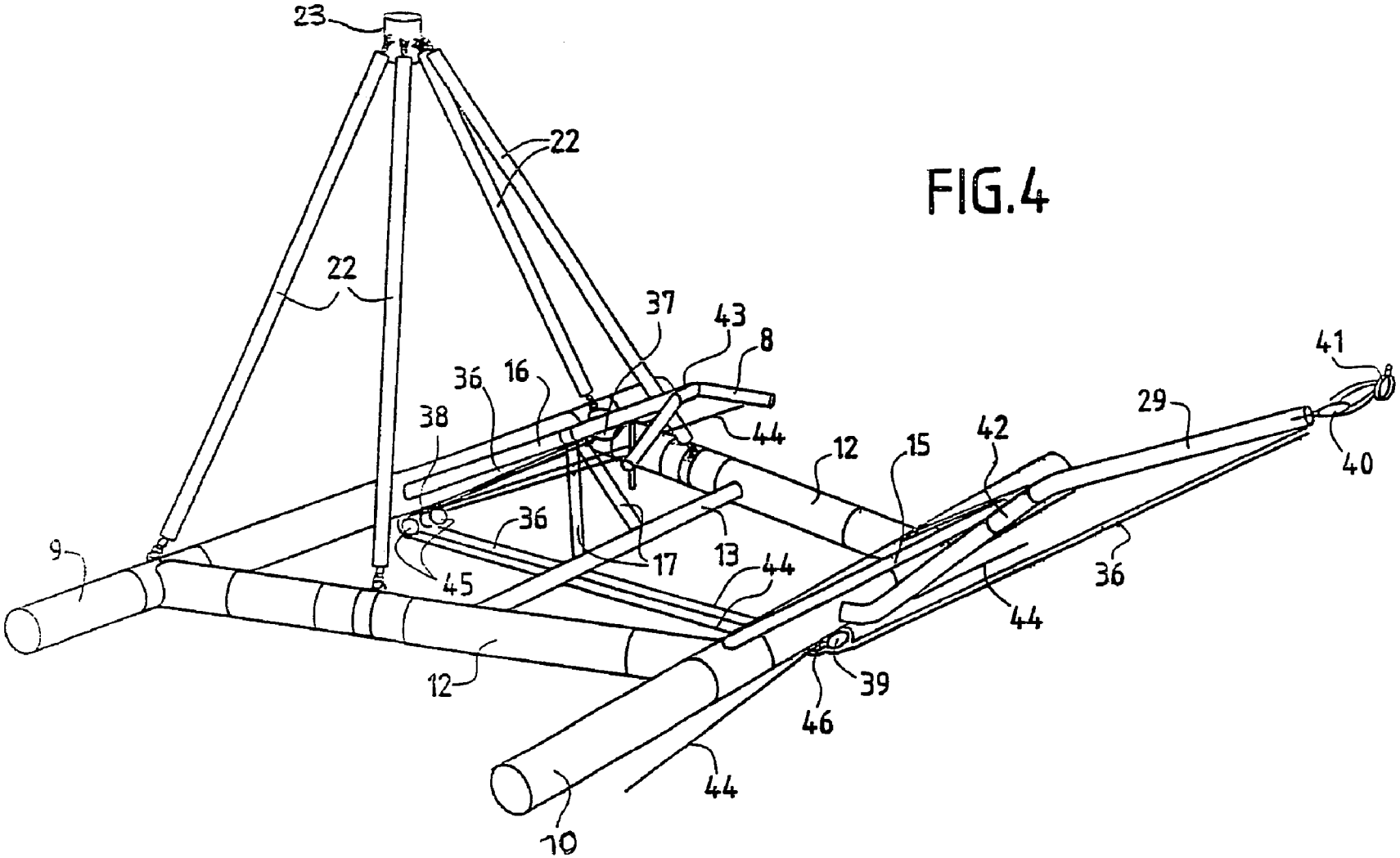
Figure 5:
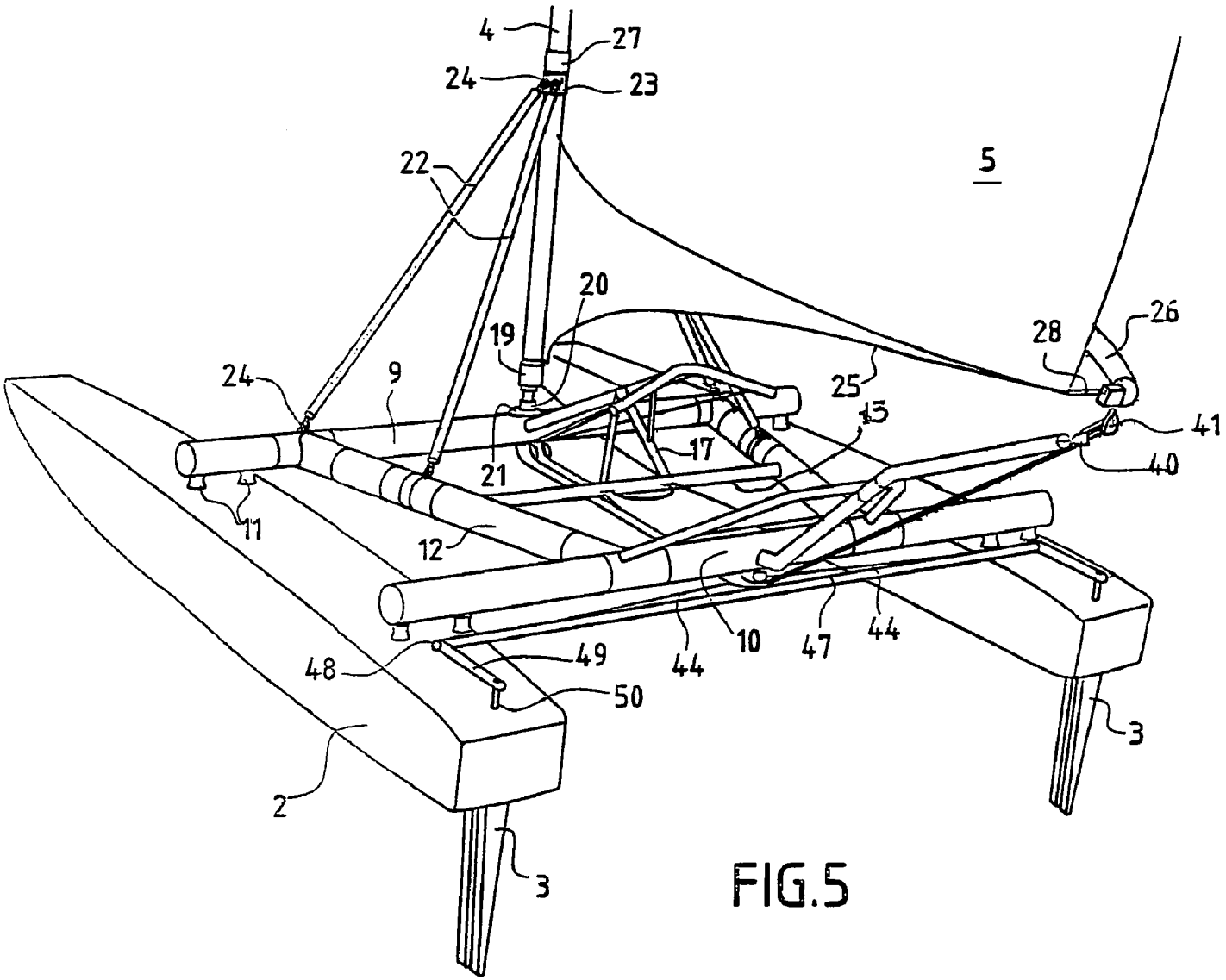

FIGS. 3*a* to 3*c* depict views in section of the float of FIG. 2 on the planes A—A, B—B and C—C, respectively;

FIG. 4 depicts an overall view of the framework of the craft, the seat having been removed so as to show the craft's steering devices;

and FIG. 5 shows a view of the craft from the rear.

The craft will be described in its position of use on an expanse of water, considering that it is traveling with its longitudinal axis directed toward a heading.

It comprises a chassis 1 formed of rigid tubes connected together. These tubes are made of a light-weight material which has the ability to sustain elastic deformation. Thus, the elements of the chassis 1 have the ability to support the forces exerted on the craft, on the one hand, by impacts with the expanse of water and, on the other hand, by gusts of wind. This provides for better comfort for the user. Materials that can be used according to the invention are, for example, aluminum or fiber-reinforced polymers, reinforced with fibers such as carbon fibers.

The chassis 1 has a longitudinal vertical plane of symmetry passing through the longitudinal axis of the craft.

It supports two longitudinal hulls in the form of two parallel floats 2 via which the craft rests on the water, which are spaced apart on each side of the plane of symmetry of the chassis 1 and which are symmetric with respect to one another relative to this plane. The floats have a wide and shallow shape corresponding to that of a planing hull with the ability to glide over the surface of the water. Thus, when the craft is traveling at a certain speed, the floats lift up so that they are submerged in the water by just a few millimeters.

Each of the floats 2 bears, at its rear end, on its underside, that is to say on the side submerged in the water, an orientable rudder blade 3. The two rudder blades 3 are steered jointly in order to steer the craft.

The chassis 1 also supports a mast 4 bearing a sail 5 which provides the craft with motive power using the strength of the wind.

Finally, it supports a cockpit situated in a central position in the craft, between the two floats 2 and symmetric with respect to the plane of symmetry of the chassis 1. This cockpit comprises a bottom wall 6, a seat 7 allowing one to sit in the longitudinal direction of the craft, and a handlebar 8 where the controls for steering the craft using the rudder blades 3 and the controls for orienting the sail 5 are situated.

The chassis 1 comprises two main members transverse to the longitudinal direction of the craft situated in a plane parallel to the expanse of water which defines the base plane of the chassis, and parallel to one another, namely a front member 9 and a rear member 10. At the lateral ends of each of these members, or cross members, on its underside, there are pads for the attachment of the floats 2, it being possible for said pads 11 (FIG. 5) to be flexible or rigid. The floats are fixed to the members 9 and 10 in a position that is offset toward the rear, so that their front part protrudes extensively from the front of the chassis 1.

The transverse members 9 and 10 are connected to one another by two longitudinal members 12, situated in the same plane, which are in fact directed obliquely symmetrically on each side of the plane of symmetry of the chassis 1 so as to form a rigid trapezium between the two floats 2. The wide base of the trapezium is toward the front of the craft, as indicated in FIG. 1.

The oblique members 12 are connected to one another by a bar 13, which constitutes a secondary cross member, positioned parallel to the members 9 and 10 and more or less equidistant between these members. Its role is not so much to reinforce the rigid structure of the chassis as to form, as necessary, an element for attaching a seat in which the helmsman can sit and/or an element on which he can rest his feet.

Figure 1:
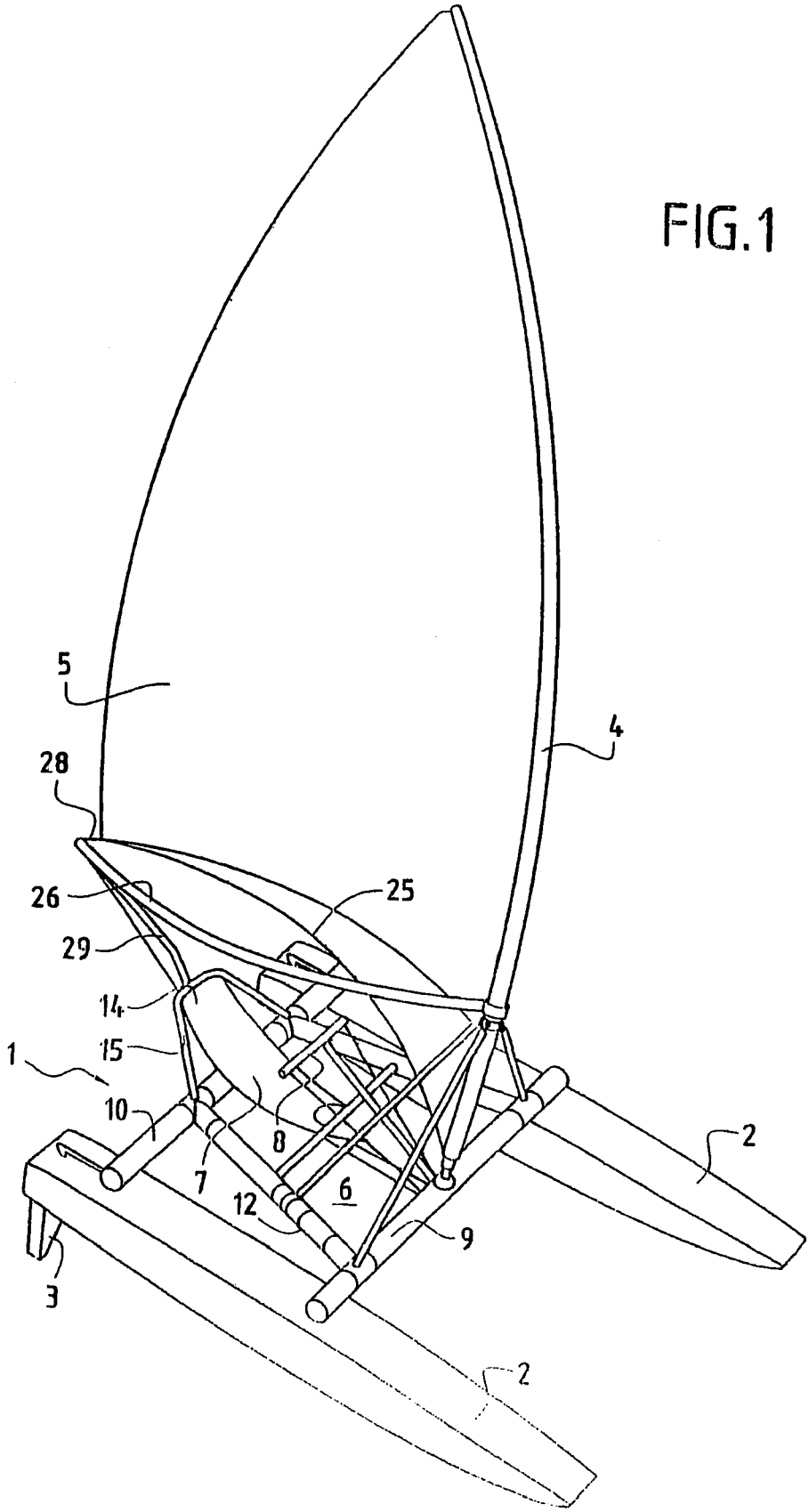
FIG. 1 depicts an overall view of the craft according to the invention.

In the embodiment depicted in FIG. 1, the bottom wall 6 occupies the entire surface area of the trapezium formed. It is also possible to envisage, within the context of the invention, having a bottom wall only in certain parts of the trapezium, for example a canvass fixed between the rear member 10 and the cross member 13 particularly in the part where the helmsman will sit. This bottom wall may in particular consist entirely of a canvass stretched by connectors attaching it to the elements of the chassis. It may also consist at the front of a safety net fixed to the cross member 13 and preventing the helmsman's legs from dropping into the water and protecting the various cables controlling the rudder blades and the sheet and, at the rear, near the seat 7, that is to say in the place where the helmsman will sit, may consist of a rigid wall.

In the particular case of the figures, the seat 7 essentially consists of a flexible canvass 14 which is fastened at the front to the cross member 13 and suspended at the rear from a bow 15 secured at its base to the rear member 10 and rising up above the latter so that the canvass 14 forms, for the user, a hammock of variable attitude. The user can thus sit on the canvass 14, with his feet resting on the bottom wall 6, causing his center of gravity to coincide with that of the craft, giving it all better stability. During sailing, the helmsman can shift his weight as he wishes longitudinally in the seat 7, in particular to balance the center of gravity of the craft in the fore and aft direction according to the external conditions so as to control the trim of the craft and minimize the listing and/or pearling. He can brace himself by pressing his feet against the front member 9 or against the intermediate cross member 13.

The handlebar 8 is positioned in front of the seat 7, at a height with respect to the base plane of the chassis 1. It has a slightly curved shape, bulging rearward, which brings its two lateral handles closer to the user. It is mounted at the end of a handlebar stem 16 situated in the plane of symmetry of the chassis, sitting its base on the front member 9 and rising up rearward relative to this member. The handlebar stem 16 is supported more or less at its middle by two rigid supports 17 (FIG. 4) fixed to the cross member 13 and therewith forming an isosceles triangle that has symmetry with respect to the plane of symmetry of the chassis. The handlebar 8 is pivot-mounted about an axis transverse to it and more or less perpendicular to the handlebar stem 16 so that it can tilt about this axis while remaining in a plane containing the axis of the handlebar stem 16, and which is therefore inclined more toward the horizontal than toward the vertical.

In some preferred embodiments of the invention, the handlebar stem 16 is adjustable for length so that it can easily be tailored to different builds of user. Thus, when the helmsman is sitting on the seat 7, he can easily reach the handlebar 8 with his arms partly bent. By pulling or pushing on the handles at the ends of the handlebar, he directs it in an oblique plane containing the axis of the handlebar stem 16 without the handlebar coming into contact with his legs. Such an embodiment of the device for controlling the direction of travel of the craft does not however limit the invention. Strictly speaking, it would be possible in particular to envisage for the handlebar stem to be more or less vertical, in which case a handlebar mounted to rotate on the actual axis of the handlebar stem so as to pivot while remaining in a plane perpendicular to the handlebar stem would likewise allow the rotation of the rudder blades to be controlled through pulling or pushing movements on the handles without the risk of knocking the helmsman's legs. However, the advantages afforded by the inclined handlebar stem would then be lost, namely that it offers a protective path to guide the cables and other flexible transmission elements that transmit the movements toward the rear of the craft by passing along rigid elements of the chassis.

The mast 4 is fixed, by its mast foot 19 (see FIG. 5) to a flexible articulation 20, for example involving a double cone of an elastomeric material in the shape of a diabolo, as is widely known in the field of sailboards. This articulated connection is itself mounted on a baseplate 21 fixed to the upper face of the front member 9, at the middle thereof. The mast 4 can therefore pivot about the axis of its mast foot 19. Furthermore, this flexible connection 20 is able to at least partially absorb the forces to which the mast 4 is subjected.

The mast 4, which is slightly flexible, is held in a vertical position, at its bottom, by shrouds consisting of rigid rods 22 which are fastened to the oblique members 12 at one of their ends and to a ring 23 at their other end, by articulations 24. The ring 23 is arranged around the mast 4 in such a way that the mast and the luff sleeve of the sail 5 can pivot freely in the ring 23. The sail 5 for this purpose has an appropriate slot near its sleeve. The mechanical strength of the rods 22 allows them to sustain the compressive forces exerted on the mast 4 and ensure that the mast operates only in bending rather than in compression between the mast foot 19 and the fixing ring 23.

In the preferred embodiment illustrated by FIG. 1, there are four shrouds placed two rods 22 per oblique member 12. However, this number is not a limitation on the invention, and it would be just as valid to use a different number of rods (at least three in order to secure the mast in all directions), as long as they allowed the mast 4 to be kept in a vertical position.

The sail 5 is held on the mast 4 by its luff sleeve and extends toward the rear of the craft from the mast 4.

This sleeve may be interrupted at the attachment of the spar 26, which is able to rotate on the mast, above the ring 23.

The lower edge 25 of the sail 5 is curved so that it has a concave shape facing downward so that when the helmsman is sitting or crouching on the seat 7, the sail 5 passes over his head without touching him. Thus, even when the sail 5 changes tack during sailing, there is no risk of the helmsman being struck by it. He therefore does not have to worry about this and can sail peacefully without having to keep his balance, concentrating solely on controlling the craft.

The sail is also sized, in conjunction with the overall width of the craft, which is defined by the distance between the outermost edges of the floats 2 at the waterline, in order to obtain a center of thrust of the wind which is as low as possible. Thus the listing movement of the craft is minimized. In order to achieve this result, the sail 5 preferably has a shape which is as wide as possible, with a lower edge which is as low as possible, within the limit of the constraints the invention is trying to observe in order to ensure that the sail always passes over the head of the helmsman sitting on the seat 7. According to criteria which are in themselves well known, the surface area of the sail 5 is also connected to the overall width, so as to obtain the best compromise between the power of the sail and the reduction of the listing, and to the overall weight of the craft.

The ring 23 for attaching the shrouds 22 to the mast 4 is situated well below the center of thrust of the wind, so as to further reduce the listing movement of the craft. Specifically, that part of the mast 4 which lies at the center of thrust of the wind has an ability to flex, thus allowing air to be released from the sail.

The sail 5 is surrounded on one side, at its widest part, by a rigid spar 26 in the form of a half bow, like the wishbone of a sailboard. This spar 26 is fixed at a front end to the mast 4 by a ring 27, situated just above the ring 23 used to fix the shrouds 22. It is connected by its rear end to the rear end of the sail 5 by a length of rope 28. The ring 27 surrounds the luff sleeve of the sail 5 and clamps it to the mast 4 so that the mast 4, the sail 5 and the spar 26 form a unit assembly which can pivot about the axis of the mast foot 19.

The spar 26 plays a part in controlling the orientation of the sail in conjunction with a rear jib boom 29 which extends greatly behind the floats 2, using a mechanism that will be described in detail further on in the description. This embodiment of the spar does not restrict the invention. In particular, it is possible to envisage using a spar in the form of a double bow completely surrounding the sail, passing along each side of it.

The shape of the floats 2 is shown in greater detail in FIGS. 2 and 3*a* to 3*c*. FIGS. 3*a*, 3*b* and 3*c* depict a view in section of the rear part, of the central part and of the front part of the float, respectively.

Each float 2 has a hull known as a planing hull. Its face on the inboard side of the craft 30 is more or less straight and its outboard face 31 is convex. Its underside 32 has a shape which is more or less straight at the rear of the craft and which is concave in the central part of the float and in its front part. The extent of concave shaping is at a maximum in the central part and reduces fairly gradually from this part toward the rear of the float and possibly also toward the front. This characteristic advantageously allows the buoyancy at the front of the floats to be increased by creating a cushion of air between the expanse of water and the float in the space made available by the concave shaping. This thus prevents the floats from pearling.

In addition, the contour 33 of the float exhibits, in its underside, a more or less rectangular overall shape with almost straight lines and corners which are sharp and as right-angled as possible. This encourages edge gripping in the water allowing the craft to sail closer to the wind and avoid the drifting effect. This shape of contour also contributes to increasing the buoyancy of the floats, particularly at the front and at the rear thereof.

In the preferred embodiment depicted in the figures, the front part of each float 2 has the shape of a spatula 34, as illustrated in FIG. 3*c*. Thus, the angle of attack at the front of the floats is increased. This spatula is produced in such a way as to be as flat as possible, in order to reduce friction with the water and improve speed performance of the craft. In preferred embodiments of the invention, the front top side 35 of the float is inclined slightly downward to reduce the volume and the weight of the floats.

Each rudder blade 3 is fixed to the corresponding float 2 at its rear part (FIG. 5) to the rear of the rear member 10 in such a way that it can move in rotation on a more or less vertical axle 50 which passes through the float to meet the upper face thereof. It is also possible, within the scope of the invention, to envisage equipping the floats with ailerons (not depicted in the figures), which may be fixed or pivoting, and particularly positioned at the front, so as to improve the anti-drift effect without thereby reducing the buoyancy of the floats.

The way of controlling the orientation of the sail and the orientation of the rudder blades from the cockpit will now be described in greater detail with reference to FIGS. 4 and 5.

The jib boom 29 is fixed to the center of the rear member 10 and rises up toward the rear from this member. It is fixed to the seat bow 15 by a fixing ring 42. Thus, on the one hand, the bow 15 supports the jib boom 29 about mid-way along its height and, on the other hand, the jib boom 29, by constituting a third bearing point for the bow 15, in addition to its points of attachment to the rear member 10, strengthens the stability of this bow.

A sheet 36 (FIG. 4) runs from the cockpit as far as the rear end of the jib boom 29 where it is slideably guided before meeting the clew point at the end of the spar. It is held on the stem 16 of the handlebar 8 by means of a cleat, for example a jamming cleat 37, allowing its useful length to be adjusted. From the jamming cleat 37, the sheet 36 runs along the handlebar stem before being returned in succession by a return pulley 38 fixed to the front member 9 then by a return pulley 39 fixed to the rear member 10. In the case illustrated by the figure, it runs between these two pulleys along the plane of symmetry of the craft under the floor canvass 6 (FIG. 1), but it might often be more advantageous to cause it to follow a path along-side one of the longitudinal members 12. The sheet 36 then runs along the jib boom 29 and is returned by a pulley 40 fixed to rotate on the end of the jib boom 29, then by a pulley 41 fixed to rotate on the rear end of the spar 26.

Thus, in order to orient the sail 5, all the helmsman sitting on the seat 7 needs to do is to release the sheet 36 from the jamming cleat 37 then pull on it or release it in order to incline the spar 26 to a greater or lesser extent and thus haul the sail 5 aft to a greater or lesser extent according to the direction of the wind and the heading followed. When the sheet 36 is pulled in as far as it will go, the spar 26 and the sail 5 position themselves in the longitudinal direction of the craft, whereas, when it is released, this assembly positions itself at a certain angle with respect to this direction, which angle varies according to the length of sheet 36 released. Once the desired position has been reached, the user once again immobilizes the sheet 36 in the jamming cleat 37; he is then in a cruising position.

This embodiment advantageously makes it possible for the pulling on the sail 5 via the sheet 36 that connects it to the spar 26 to be exerted always at right angles to the axis of rotation of the mast 4. This pulling therefore leads to no deformation of the profile of the sail 5, and better performance is obtained in terms of the speed of the craft.

The jib boom 29 is made of a material of the same type as the material that makes up the elements of the chassis 1, that is to say is rigid while at the same time having a small ability to sustain elastic deformation. This characteristic allows it to sustain some of the forces applied to the sail 5, before transmitting them to the chassis 1 of the craft in order to propel the latter. This relative flexibility works in favor of the level sailing of the craft while at the same time ensuring that a relatively high speed of travel can be achieved.

The handlebar 8 is mounted at its middle on the handlebar stem 16 via an articulation 43 (FIG. 4) such that it can pivot about an axis more or less perpendicular to the handlebar stem 16. One of its ends can therefore be pulled or pushed under conditions in which it remains in a plane containing the axis of the handlebar stem 16.

To transmit the steering commands, a cable 44 is fixed to each end of the handlebar 8 on each of its handles. Each of the cables 44 is returned by a return pulley 45 fixed to the front member 9, toward a return pulley 46 fixed to the rear member 10. At the pulleys 46, each of the two cables 44 is directed, along the rear member 10, toward one or other of the floats 2, respectively. Up to that point, the two cables were following more or less the same path as the sheet 36. In other words, having run along the handlebar stem 16, it may be desirable for them to run along other elements of the rigid chassis, the symmetric longitudinal members 12 in particular.

A linkage 47 (FIG. 5) is situated at the rear of the rear member 10, parallel to the latter and forward of the axes of rotation 50 of the rudder blades 3 on their respective hulls. It coordinates the movements of the two rudder blades. Each of its lateral ends is positioned above a float 2, more or less on the mid-line thereof. The cables 44 are each fixed to one end of the linkage 47. At each of its ends, the linkage 47 is connected by an articulation 48 to a rudder blade bar 49 which is transverse to it and extends toward the rear of the craft. The rudder bars 49 can pivot freely on the articulation 48. At their opposite end they are each fixed to the axle 50 of a rudder blade 3 so as to drive it in rotation.

When the helmsman wishes to cause the craft to turn, for example to the right, all he has to do is pivot the handlebar 8 by pulling it toward him with his right hand and/or pushing on the other side (on the other handle) using his left hand. This then produces a pulling action on the cable 44 in operation on the side to the right of the axis of symmetry of the craft, which is fixed to the right-hand end of the handlebar. At the rear pulley 46, this cable then pulls on the right-hand end of the linkage 47. As the pulling force is exerted here by the cable in a more or less transverse direction along the rear member of the chassis, it causes a leftward translational movement of the linkage. In its movement, the linkage 47 acts on the two bars connected to the rudder blades and, by pulling one and pushing the other, exerts a couple which causes them both to turn in the same direction about the respective axles on which they are mounted. In the case in question, the rotational movement of the rudder axles 50 causes the simultaneous pivoting of the two rudder blades 3 to the right with respect to the axis of symmetry and the craft therefore turns to the right. The helmsman therefore performs a movement comparable to that of a cyclist pushing his handlebar on the opposite side to the direction in which he wishes to turn. A turn to the left is performed by carrying out the reverse action.

Thus, the craft according to the invention is entirely simple and comfortable to use because the helmsman sails sitting on the seat 7 or even semi-standing on the bottom wall 6, in a central position within the craft, and has within his reach all the controls of the craft, namely the control for orienting the sail using the sheet 36 fixed under the handlebar 8 for propelling the craft, the control for steering the rudder blades using the handlebar 8 in order to control the direction of the craft plus possibly the control for shifting the center of gravity of the craft by shifting his own body longitudinally on the seat. Further, during these movements, the helmsman remains in constant control of the controls.

Of course, the invention is not restricted to the embodiments specifically described in the course of the above examples. On the contrary, it extends to cover any variant that uses equivalent means.

In particular, the articulation of the mast foot 19 to the chassis 1 may be such that it allows the mast to be inclined toward the horizontal, particularly in the longitudinal direction of the craft. This allows the mast to be brought into a horizontal position for fitting the sail when preparing the craft before putting it into the water. Once the luff sleeve of the sail has been slipped over the mast, the latter is then brought into the operational position by fixing the ends of the rods 22 to the ring 23 which is slipped through a slot in the sail formed near its luff sleeve. It is also possible, for example, to provide a ball joint articulation for the articulation 24 in order to incline the mast 4. In this case, provision may also be made for the two rear mast-fixing rods 22 which are fixed to the oblique members 12 to be slideably mounted on these members, so that the inclination of the mast 4 can be adjusted. The inclination is then adjusted at the time of attachment of the rods to the oblique members 12.

The invention claimed is:

1. A sailing craft comprising a chassis (1) connecting two float-forming hulls (2) and a sail (5) for wind-powered travel when the floats are on an expanse of water, said craft comprising a central cockpit (6–8) where a helmsman can remain seated and have, within reach, controls for controlling said sail (5) and steering controls which determine variations in orientation, with respect to the longitudinal axis of said craft, of rudder blades (3) with which each of said hulls (2) is respectively equipped, characterized in that said steering controls comprise a handlebar (8) which is fixed such that it can pivot at the end of a handlebar stem (16) and which has two symmetric lateral handles for driving, by pulling on them, two steering control cables (44) each of which is fixed at its respective other end to two symmetric lateral ends of a coordination linkage (47) rigidly connecting two bars which rotate as one with a respective one of the two rudder blades (3), said coordination linkage (47) being situated forward with respect to the rotation axle (50) of said rudder blades (3) on their respective hulls, said cables being forced to follow a guide path with respect to the elements of said chassis which meets said ends of the linkage in a substantially transverse path in order to cause said linkage to move in a translational movement.

2. A craft as claimed in claim 1, characterized by the fact that said sail is connected along the entire length of its front edge to a mast borne by said chassis, said central cockpit (6–8) comprising a seat (7), said controls for controlling said sail (5) comprising a cleat for adjusting the useful length of a sheet for controlling the orientation of the sail with respect to said chassis which is slideably guided over a return pulley provided at the end of a boom fixed as a jib boom at the rear of the craft beyond said floats to meet a fixed clew point of the sail situated at the end of a spar (26) for longitudinally tensioning the sail which is mounted to rotate about the mast.

3. The craft as claimed in claim 2, in which said hulls are designed to operate as planing hulls and in which said jib boom fixed at the rear of the chassis (1) extends rearward beyond the two hulls as far as a tack of the sheet that controls the sail, which tack is also offset heightwise relative to said chassis.

4. The craft as claimed in claim 3, in which in addition said sail is curved at its lower edge so as to leave space to prevent the swinging of the sail from one side of the craft to the other impeding the user positioned in the cockpit.

5. The craft as claimed in claim 3, in which said sail (5) is configured, in terms of the ratio between its length at rest along the longitudinal axis of said craft and its height along a mast (4), in such a way that the center of thrust of the wind is fairly low down on the waterline defined by said hulls (2) so as to limit the possibilities of the craft listing enough to prevent any risk of capsizing, particularly with said length being relatively long and said height being relatively short.

6. The craft as claimed in claim 2, in which in addition said sail is curved at its lower edge so as to leave space to prevent the swinging of the sail from one side of the craft to the other impeding the user positioned in the cockpit.

7. The craft as claimed in claim 2, in which said sail (5) is configured, in terms of the ratio between its length at rest along the longitudinal axis of said craft and its height along a mast (4), in such a way that the center of thrust of the wind is fairly low down on the waterline defined by said hulls (2) so as to limit the possibilities of the craft listing enough to prevent any risk of capsizing, particularly with said length being relatively long and said height being relatively short.

8. The craft as claimed in claim 1, in which in addition said sail is curved at its lower edge so as to leave space to prevent the swinging of the sail from one side of the craft to the other impeding the user positioned in the cockpit.

9. The craft as claimed in claim 8, in which said sail (5) is configured, in terms of the ratio between its length at rest along the longitudinal axis of said craft and its height along a mast (4), in such a way that the center of thrust of the wind is fairly low down on the waterline defined by said hulls (2) so as to limit the possibilities of the craft listing enough to prevent any risk of capsizing, particularly with said length being relatively long and said height being relatively short.

10. The craft as claimed in claim 1, in which said sail (5) is kept longitudinally taut by a spar (26) some distance from a mast (4) supporting said sail (5) which mast stands up from a fixed mast foot (19) situated on the longitudinal axis of said craft, said mast being held in a more or less vertical position at its bottom by shrouds (22), preferably three of these, consisting of rigid rods fixed obliquely to said chassis (1), said rods (22) preferably being fixed to a ring (23) in which said mast (4) can turn, said ring (23) advantageously being positioned below the center of thrust of the wind.

11. The craft as claimed in claim 10, in which said sail (5) is configured, in terms of the ratio between its length at rest along the longitudinal axis of said craft and its height along a mast (4), in such a way that the center of thrust of the wind is fairly low down on the waterline defined by said hulls (2) so as to limit the possibilities of the craft listing enough to prevent any risk of capsizing, particularly with said length being relatively long and said height being relatively short.

12. The craft as claimed in claim 1, in which said sail (5) is configured, in terms of the ratio between its length at rest along the longitudinal axis of said craft and its height along a mast (4), in such a way that the center of thrust of the wind is fairly low down on the waterline defined by said hulls (2) so as to limit the possibilities of the craft listing enough to prevent any risk of capsizing, particularly with said length being relatively long and said height being relatively short.

13. The craft as claimed in claim 1, in which said central cockpit is positioned along the axis of said craft, in a space left free above the waterline between said two hulls (2), and in that it comprises a user seat (7) produced in such a way that the user can shift his weight forward and backward, and if appropriate, also from one side of the craft to the other.

14. The craft as claimed in claim 13, characterized by the fact that said seat comprises a canvass stretched between two cross members of the chassis connecting the two hulls.

15. A craft as claimed in claim 1, characterized by the fact that said controls for controlling said sail comprise a sheet (36) adjustable in its length in order to modify the orientation of the sail (5), said sheet (36) running from a cleat (37) for securing its free end at the cockpit to a clew point of said sail (5), being returned successively by a pulley (38) fixed to a front member (9) of said chassis (1) and by a pulley (39) fixed to a rear member (10) of said chassis.

* * * * *